US006543187B1

(12) United States Patent
Menzies

(10) Patent No.: US 6,543,187 B1
(45) Date of Patent: Apr. 8, 2003

(54) HOUSING FOR ENCLOSING THE JUNCTURE BETWEEN A ROOF AND A CONDUIT EXTENDING THROUGH THE ROOF

(76) Inventor: Samuel John Menzies, 19370 - 60th Avenue, Surrey, British Columbia (CA), V3S 8E5

( * ) Notice: Subject to any disclaimer, the term of this patent is extended or adjusted under 35 U.S.C. 154(b) by 0 days.

(21) Appl. No.: 09/983,845

(22) Filed: Oct. 26, 2001

(51) Int. Cl.[7] ..... E04D 3/38; E04D 13/14; E04B 7/00; E04H 12/28

(52) U.S. Cl. ..... 52/58; 52/60; 52/199; 52/218; 52/219

(58) Field of Search ..... 52/58, 60, 198, 52/199, 218, 219; 285/42, 43, 44, 179.1, 179.2

(56) References Cited

U.S. PATENT DOCUMENTS

| | | | | | |
|---|---|---|---|---|---|
| 2,706,395 | A | * | 4/1955 | McCrea | 110/184 |
| 2,800,850 | A | * | 7/1957 | McKann | 285/44 |
| 2,856,837 | A | * | 10/1958 | Thulman | 126/307 R |
| 2,956,495 | A | * | 10/1960 | Sublette | 285/43 |
| 3,089,521 | A | * | 5/1963 | Paiement | 138/158 |
| 3,742,659 | A | | 7/1973 | Drew | |
| 3,757,812 | A | * | 9/1973 | Duncan | 137/142 |
| 3,802,131 | A | * | 4/1974 | Resech | 52/200 |
| 3,838,544 | A | * | 10/1974 | Hindall | 52/219 |
| 4,102,090 | A | * | 7/1978 | Anguish | 285/42 |
| 4,158,276 | A | | 6/1979 | Stoneman | |
| 4,366,652 | A | | 1/1983 | Mueller | |
| 4,480,534 | A | * | 11/1984 | Sloan | 454/182 |
| 4,635,409 | A | * | 1/1987 | Vandemore | 138/159 |
| 4,890,546 | A | | 1/1990 | Venge | |
| 4,937,991 | A | * | 7/1990 | Orth | 138/157 |
| 4,970,837 | A | * | 11/1990 | Fogelstrom | 52/244 |
| 5,148,647 | A | * | 9/1992 | Rutledge | 52/302.1 |
| 5,349,790 | A | * | 9/1994 | Beetles et al. | 52/19 |
| 5,946,863 | A | | 9/1999 | Bullard | |

FOREIGN PATENT DOCUMENTS

| | | | |
|---|---|---|---|
| CA | 612978 | * | 1/1961 |
| CA | 2080437 | | 4/1994 |
| DE | 2 144 452 | * | 3/1973 |

* cited by examiner

*Primary Examiner*—Carl D. Friedman
*Assistant Examiner*—Kevin McDermott
(74) *Attorney, Agent, or Firm*—Lance A. Turlock

(57) ABSTRACT

A conduit housing for enclosing the juncture between a roof and an elongated conduit such as flexible cable or a pipe extending upwardly through the roof is disclosed. The housing may be installed while the conduit remains in situ and without disconnecting the conduit from an external utility to which it is connected. The housing includes first and second base sections, a hood, and a conduit opening extending through a side wall of the housing. The base sections are slidably engageable with each other around the conduit on the roof to form a base assembly. The base assembly has an open top and extends peripherally around an interior region containing a lower portion of the conduit. The hood is engageable with the base assembly to cover at least the open top of the base assembly. The conduit opening is sized to provide a passage for the conduit from within the interior region to an external region outside the housing, and it may extend through a side wall of the base assembly or a side wall of the hood.

6 Claims, 8 Drawing Sheets

HOUSING FOR ENCLOSING THE JUNCTURE BETWEEN A ROOF AND A CONDUIT EXTENDING THROUGH THE ROOF

BACKGROUND OF THE INVENTION

The present invention relates to housings for placement on roofs and, in particular, to conduit housings for enclosing the juncture between a roof and a conduit (for example, a pipe or a cable) extending upwardly through the roof.

When a building is constructed, one or more conduits, each having a particular purpose, may extend upwardly through the roof. Once past the juncture between the roof and the conduit, any given conduit may extend for a relatively short distance (e.g. a vent pipe), an intermediate distance (e.g. a pipe leading to an air conditioner or other external utility placed elsewhere on the roof), or a relatively long distance (e.g. a cable carrying electrical wires to power lines, telephone lines or other external utility distant from the roof). In all cases, it is of course important to ensure that the juncture between the roof and the conduit is adequately sealed to prevent leakage through the roof. Typically, required sealing is accomplished with the aid of housings or flashings that are integrated with the structure of the roof.

After a building is constructed (typically and hopefully years after), it may become necessary to re-surface the roof of the building. When this necessity arises, those conduits that extend through the roof and which are connected to external utilities such as those mentioned above frequently present a problem. Existing conduit housings often must be removed and replaced. However, their structure typically does not admit to replacement without first disconnecting the conduits from the utilities to which they are connected, then installing the replacement housing, then reconnecting the conduits to their respective utilities. The cost of breaking and remaking such connections can add significantly to the cost of re-surfacing a roof.

BRIEF SUMMARY OF THE INVENTION

A primary object of the present invention is to provide a new and improved conduit housing for enclosing the juncture between a roof and a conduit extending through the roof, and which can be quickly and easily installed while the conduit is connected to an external utility.

Another object of the present invention is to provide a conduit housing of the foregoing type that can be manufactured in minimal parts off site and subsequently assembled and installed on site with minimal labor.

In one aspect of the present invention, a further object is to provide a conduit housing of the foregoing type which is particularly well adapted for cases where the conduit is a flexible cable.

In another aspect of the present invention, a further object is to provide a conduit housing of the foregoing type which is particularly well adapted for cases where the conduit is a rigid pipe extending upwardly through a roof then horizontally above and across the roof.

In a broad aspect of the present invention there is provided a conduit housing for enclosing the juncture between a roof and an elongated conduit while the conduit is in situ. The conduit comprises a first portion extending upwardly through the roof and a second portion extending horizontally above the roof. The housing comprises first and second base sections, a hood, and a conduit opening extending through a side wall of the housing. In one embodiment, the side wall is a side wall of one of the base sections. In another embodiment, the side wall is a side wall of the hood.

The base sections are horizontally slidably engageable on the roof with each other around the conduit to form a base assembly. The base assembly has an open top and extends peripherally around an interior region containing at least a lower portion of the first portion of conduit. The hood is engageable with the base assembly to cover at least the open top of the base assembly. The conduit opening is sized to provide a passage for the second portion of the conduit from within the interior region to an external region outside the housing.

In preferred embodiments, the base assembly comprises four sides adjoined to define the interior region, each of the sides comprising an outwardly extending base flange securable to the roof, an intermediate side wall extending on a cant upwardly and inwardly from the base flange; and, an upper side wall extending substantially vertically from the intermediate side wall to the open top. Three of the four sides are preferably associated with one of the two base sections while the remaining fourth side is associated with the other of the two base sections. When engaged to form the base assembly, the separate identity of the two base sections is lost for all practical purposes. However, the resulting assembly is one which easily can be integrated with the structure of a roof using conventional roofing practices.

In an embodiment preferred for cases where the conduit is a flexible cable, the conduit opening extends down from the top of one of the upper side walls of the base assembly. Further, a conduit channel preferably extends outwardly from the conduit opening, the channel being sized to provide a passage for the conduit/cable for a distance outwardly from the opening. The hood is sized to cover both the open top of the base assembly and said channel.

In an embodiment preferred for cases where the conduit is a rigid pipe, the hood comprises a top wall and side walls extending downwardly from the top wall to an open bottom. Upper side walls of the base assembly extend upwardly wholly within the side walls of the hood, and the conduit opening is located in a front one of the side walls of the hood. In cases where it is desired to have a structure that easily can be easily adapted to pipes extending horizontally above roofs at differing elevations, the front one of the side walls advantageously includes an elongated slot extending upwardly from the open bottom of the hood, and the conduit opening is an opening between a longitudinally abutting pair of panels extending across the slot while slidably engaged with the front one of the side walls.

The foregoing and other features of the present invention, and resulting advantages, will now be described with reference to the drawings.

DETAILED DESCRIPTION

Figure 1:
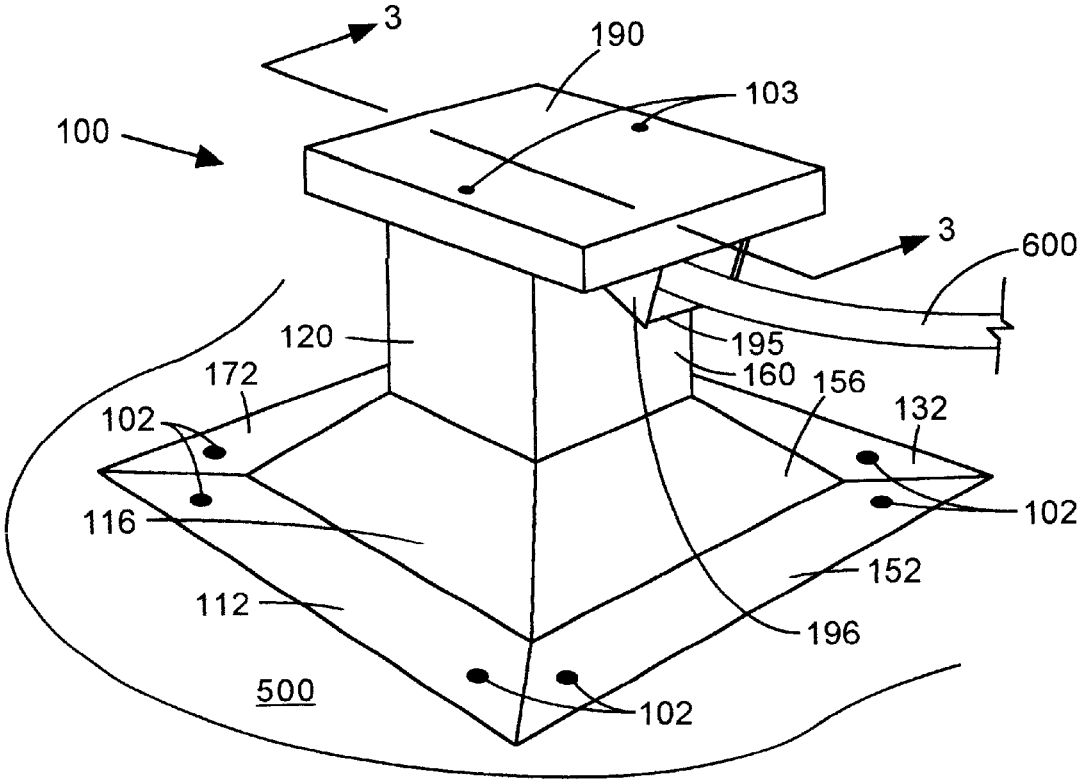
FIG. 1 is a perspective view of a housing in accordance with the present invention used to enclose the juncture between a roof and an elongated flexible cable extending upwardly through the roof. For the purpose of illustration, integration of the housing with the roof is not shown.

Three conduit housings in accordance with the present invention are shown in the drawings. The first as shown in FIGS. 1–7 is a housing generally designated 100 used to enclose a juncture 510 between a roof 500 and an elongated flexible cable 600 extending upwardly through the roof. The second as shown in FIGS. 8–17 is a housing generally designated 200 used to enclose a juncture 511 between roof 500 and a pipe 700. The third as shown in FIG. 18 is a housing,generally designated 300 used to enclose a juncture (not shown) between roof 500 and a pipe 800.

Embodiment Shown in FIGS. 1–7

Housing 100 includes first and second base sections generally designated 110, 170 (see FIG. 5) slidably engageable with each other to form a four-sided base assembly generally designated 101 (see FIG. 2); and a hood 190. A conduit opening 166 extends through side wall 160 of the base assembly, and a U-shaped conduit channel 195 extends outwardly from the opening. Channel 195 is sized to provide a passage for cable 600 for a distance outwardly from opening 166 and is preferably capped by lid 196 which slidingly fits over the sides of the channel. Hood 190 is engageable with base assembly 101 to cover both the open top defined by perimeter 105 and channel 195. Apart from fasteners or welds (not shown) that may be used to join various parts, the entire housing is preferably fabricated from thin sheet metal such as aluminum.

Base section 110 has a generally three-sided construction, two of the three sides being opposed to each other and extending in parallel; the third side transversely interconnecting the opposed sides. The opposed sides have a mirror image construction.

One of the opposed sides includes an outwardly extending base flange 112, an intermediate side wall 116 merging with and extending on a cant (preferably about 45 degrees) upwardly and inwardly from flange 112; and an upper side wall 120 merging with and extending vertically from wall 116 to perimeter 105. An inverted L-shaped flange 125 extends outwardly from the top of wall 120 to provide a counter-flashing. Similarly, the other of the opposed sides includes an outwardly extending base flange 132, an intermediate side wall 136 merging with and extending on a cant (again about 45 degrees) upwardly and inwardly from flange 132; and an upper side wall 140 merging with and extending vertically from wall 136 to perimeter 105. An inverted L-shaped flange 145 extends outwardly from the top of wall 140 to provide a counter-flashing.

The transverse interconnecting side of base section 110 includes an outwardly extending base flange 152 transversely interconnecting base flanges 112, 132; an intermediate side wall 156 transversely interconnecting intermediate side walls 116, 136; and an upper side wall 160 transversely interconnecting upper side walls 120, 140. Inverted L-shaped upper flanges 165*a*, 165*b* extend outwardly from the top of wall 160 to provide a counter-flashing.

Figure 5:
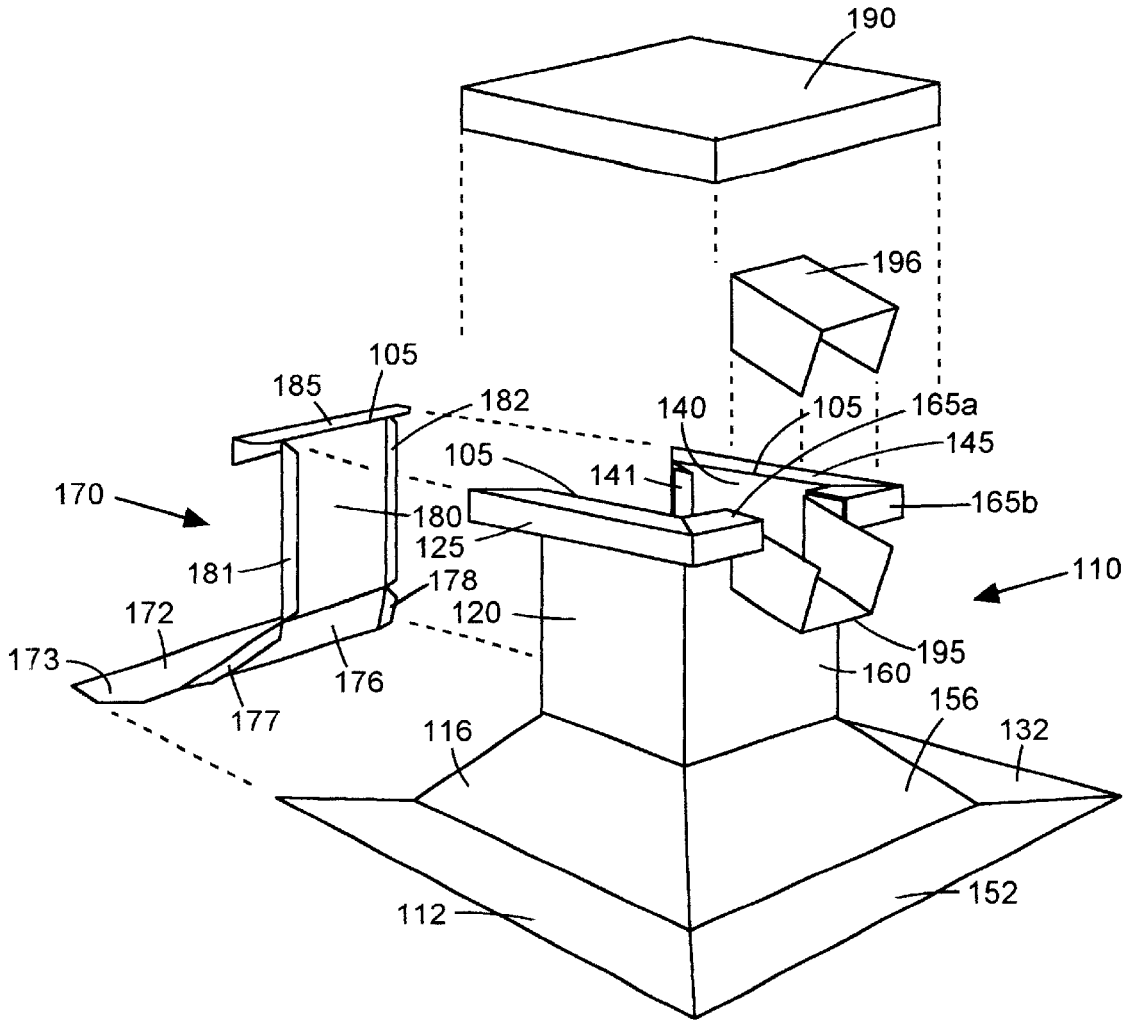
FIG. 5 is an exploded perspective view of the housing shown in FIG. 1.

Base section 170 forms the remaining side of base assembly 101. As best seen in FIG. 5, it includes an outwardly extending base flange 172; an intermediate side wall 176 extending on a cant upwardly and inwardly from flange 172; and an upper side wall 180 extending substantially vertically from wall 176 to perimeter 105. Wall 176 includes a pair of flanges 177, 178 bent inwardly at angles of 90 degrees from opposed ends of wall 156. Likewise, wall 180 includes a pair of flanges 181, 182 bent inwardly at angles of 90 degrees from opposed ends of wall 180. An inverted L-shaped upper flange 185 extends outwardly from the top of wall 180 to provide a counter-flashing.

Figure 3:
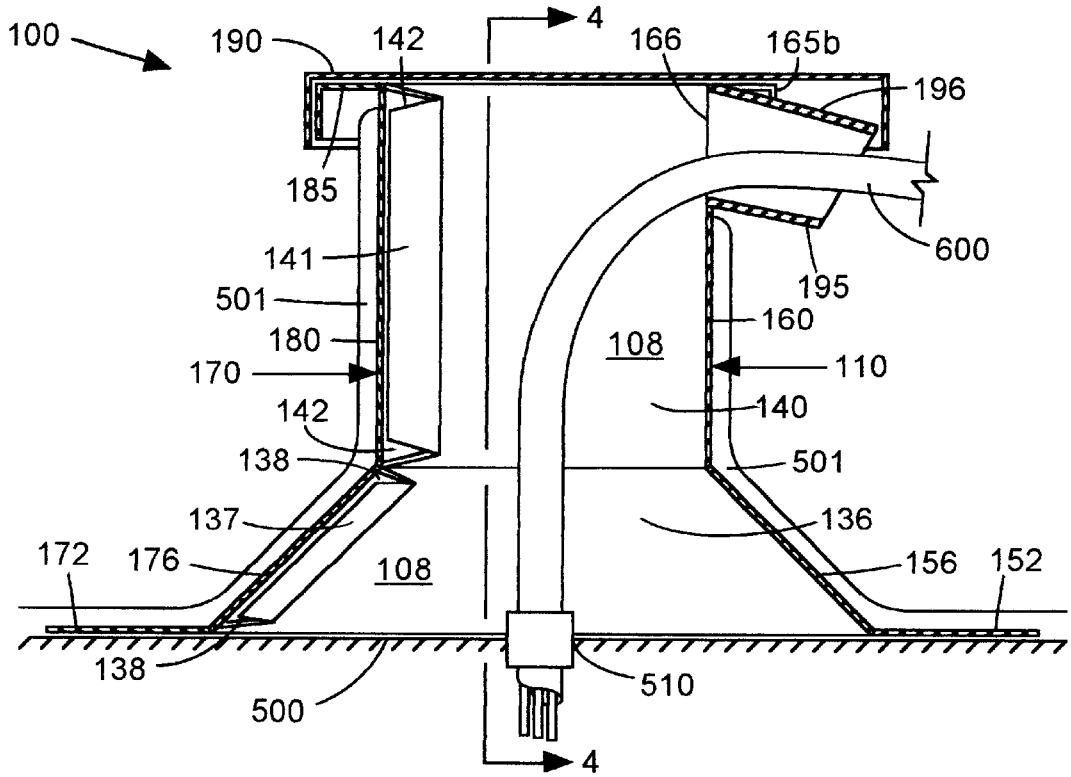
FIG. 3 is section elevation view taken in a plane containing section line 3—3 in FIG. 1, and illustrates the integration of the housing shown in FIG. 1 with a roof.
Figure 6:
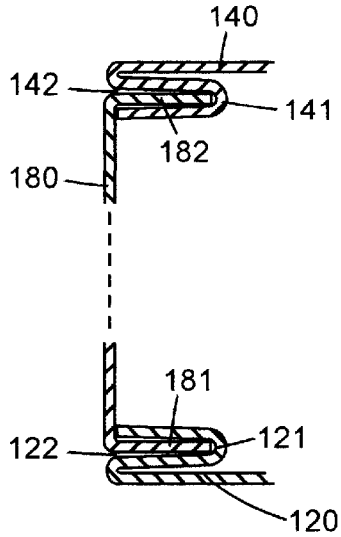
FIG. 6 is a section view illustrating engagement between walls forming part of the housing shown in FIG. 1.

To facilitate sliding engagement between base sections 110 and 170, and as best seen in FIGS. 3 and 6, wall 120 includes a folded end 121 bent to form an elongated channel 122, and wall 140 includes a folded end 141 bent to form an elongated channel 142. Similarly, wall 136 includes a folded end 137 (shown in FIG. 3 only) bent to form an elongated channel 138, and wall 116 includes a corresponding mirror image folded end (not shown). When base sections 110, 170 are brought together from the exploded positions shown in FIG. 5, channel 122 of wall 120 slidingly receives flange 181 of wall 180, and channel 142 of wall 140 slidingly receives flange 182 of wall 180. Concurrently, channel 138 of wall 136 slidingly receives flange 178 of wall 176, and the corresponding channel (not shown) of wall 116 slidingly receives flange 177 of wall 176. As an aside, it readily will be apparent that FIG. 6 is representative not only of the engagement of wall 180 with walls 120, 140 but also of the engagement of wall 176 with walls 116, 136.

Figure 7:
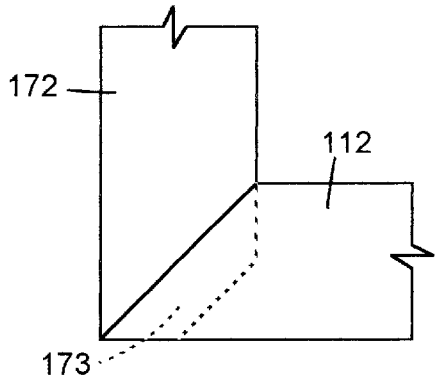
FIG. 7 is a top view illustrating the relationship between selected base flanges forming part of the housing shown in FIG. 1.

With reference to FIG. 7, it will be noted that an extended end 173 of flange 172 underlies flange 112. Although not shown, a corresponding extension at the other end of flange 172 likewise underlies flange 132. The purpose is to provide added stability to base assembly 101 when base sections 110, 170 are first engaged. When the sections are brought together, section 110 is toleranced such that the extended ends of flange 172 will frictionally slide under flanges 132, 172 thereby better holding the sections in place until further work is done. Extended end 173 is also indicated in FIG. 5.

Installation and Use

In use, the first step is to fabricate the discrete components of housing 100 as shown in FIG. 5 (viz. base sections 110, 170, hood 190 and lid 196). To minimize the amount of work required at a building site, and to take advantage of production scale efficiencies, this work is preferably done in a metal fabrication plant. The discrete components are then shipped to the building site.

Once at the building site, and with flexible cable 600 already extending in situ through roof 500 at juncture 510, the next step is to position base section 110 on roof 500 in the position shown in FIG. 3, thereby peripherally enclosing three sides of interior region 108. (Interior region 108 is that portion of the base assembly interior which lies below the bottom of opening 166. Cable 600, which extends from juncture 510 upwardly within region 108, is directed from region 108 through conduit opening 166 and channel 195.)

Figure 2:
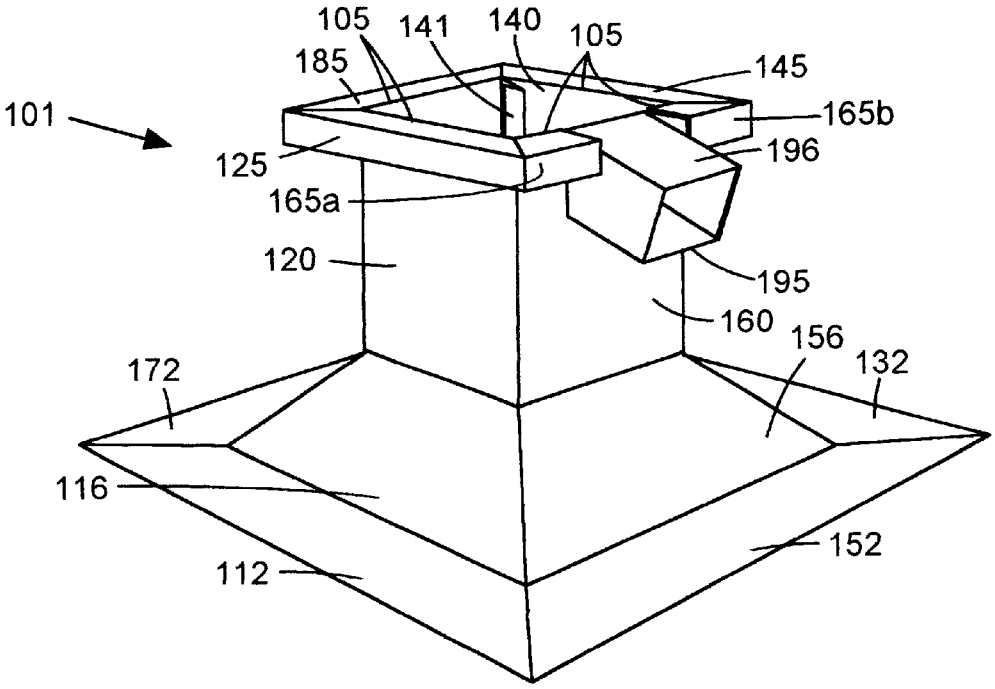
FIG. 2 is a perspective view of the housing shown in FIG. 1 with its hood removed.

Next, base section 170 is slidingly engaged with base section 110, and lid 196 is slidingly engaged with channel 195, the resulting assembly being like that shown in FIG. 2. At this point, interior region 108 if fully enclosed around its periphery. Flanges 112, 132, 152, 172 are then secured to roof 500 by means of suitable fasteners 102 (see FIG. 1). Further, lid 196 is preferably secured to channel 195 by means of suitable fasteners (not shown).

When lid 196 is in place, cable 600 is preferably sealed within channel 195. A suitable seal can be achieved using a commercially available expandable foam sealant which will expand around the cable and be bounded by channel 195 and lid 196.

Next, hood 190 is positioned atop the base assembly and secured with suitable fasteners 103 (see FIG. 1). Juncture 510 between roof 500 and cable 600 is now fully enclosed.

Figure 4:
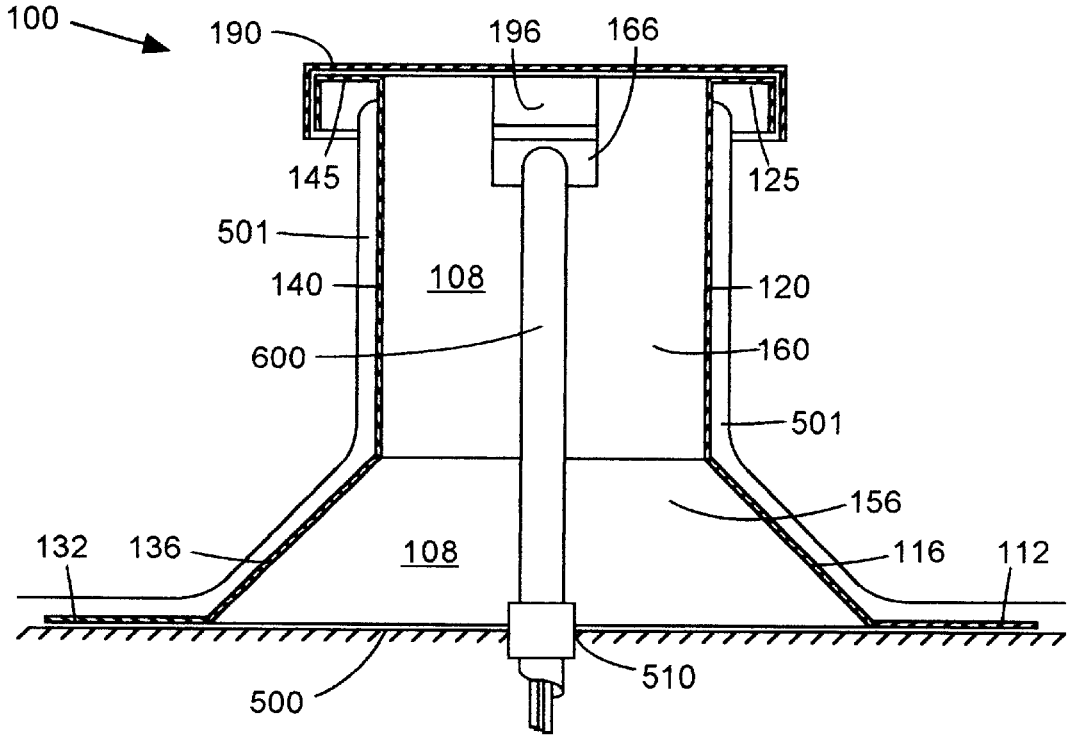
FIG. 4 is a section elevation view taken along section line 4—4 in FIG. 3, and also shows the integration of the housing shown in FIG. 1 with a roof.

Finally, and as shown in FIGS. 3–4, housing 100 is fully integrated with roof 500 when roof 500 is itself completed by the addition of a roofing surface 501. Roofing surface 501 extends across roof 500, over flanges 112, 132, 152, 172, and is then formed upwardly and over intermediate walls 116, 136, 156, 176 and upper side walls 120, 140, 160, 180. Such surfacing techniques and the materials used are well known in the art and will not be described here in further detail.

Considering, for example, that cable 600 may be a cable carrying power lines, telephone lines, or the like, it will be apparent that it may remain fully in situ during the installation of housing 100 and that there will be no need to disconnect the cable from utilities (not shown) in the region external to the housing. Further, it will be apparent that minimal work is required on site to assemble the housing and to integrate it with roof 500.

Embodiments Shown in FIGS. 8–17 and in FIG. 18

Housing 200 includes first and second base sections generally designated 210, 220 (see FIG. 10) slidably engageable with each other to form a four-sided base assembly generally designated 201 (see FIG. 9); and a hood generally designated 250. As in the case of housing 100, housing 200 is preferably fabricated from thin sheet metal such as aluminum.

Except for the following differences, base assembly 201 has substantially the same construction as base assembly 101:

Base assembly 201 does not include flanges like inverted L-shaped flanges 125, 145, 165*a*, 165*b*, 185. Instead, base assembly 201 includes flanges 230, 231, 232, 233 extending for a short distance inwardly from the upper side walls of the assembly to bound an open top defined by perimeter 205 (see FIG. 10) along the inner edges of flanges 230, 231, 232, 233.

Base assembly 201 does not include a wall opening like upper wall opening 166, or a U-shaped conduit channel like channel 195. Necessarily, it does not include a lid like lid 196. Pipe 700 which passes through base assembly 201 exits the assembly through the open top defined by perimeter 205 rather than through a side wall of the assembly.

Figure 11:
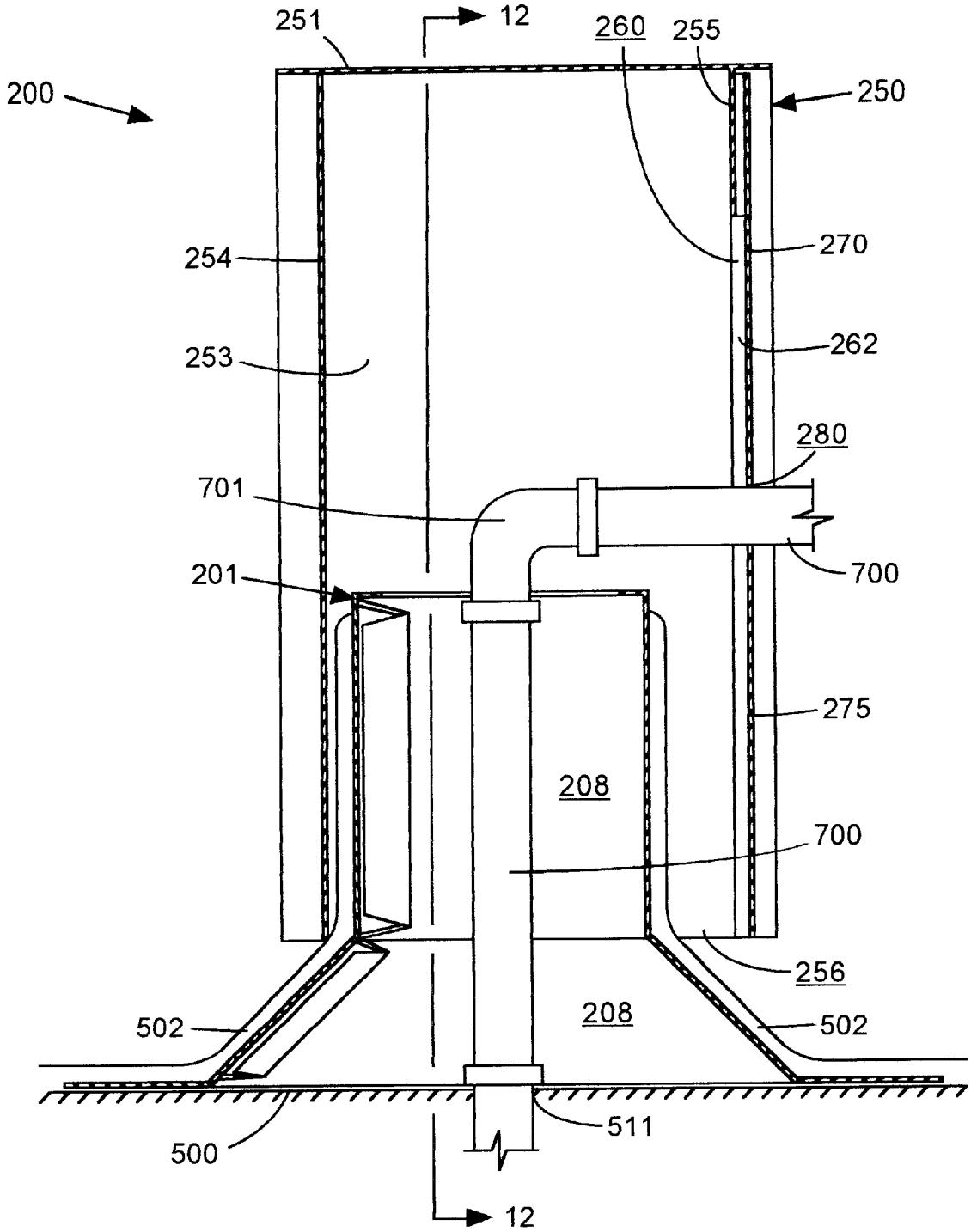
FIG. 11 is section elevation view taken in a plane containing section line 11—11 in FIG. 8, and illustrates the integration of the housing shown in FIG. 8 with a roof.
Figure 12:
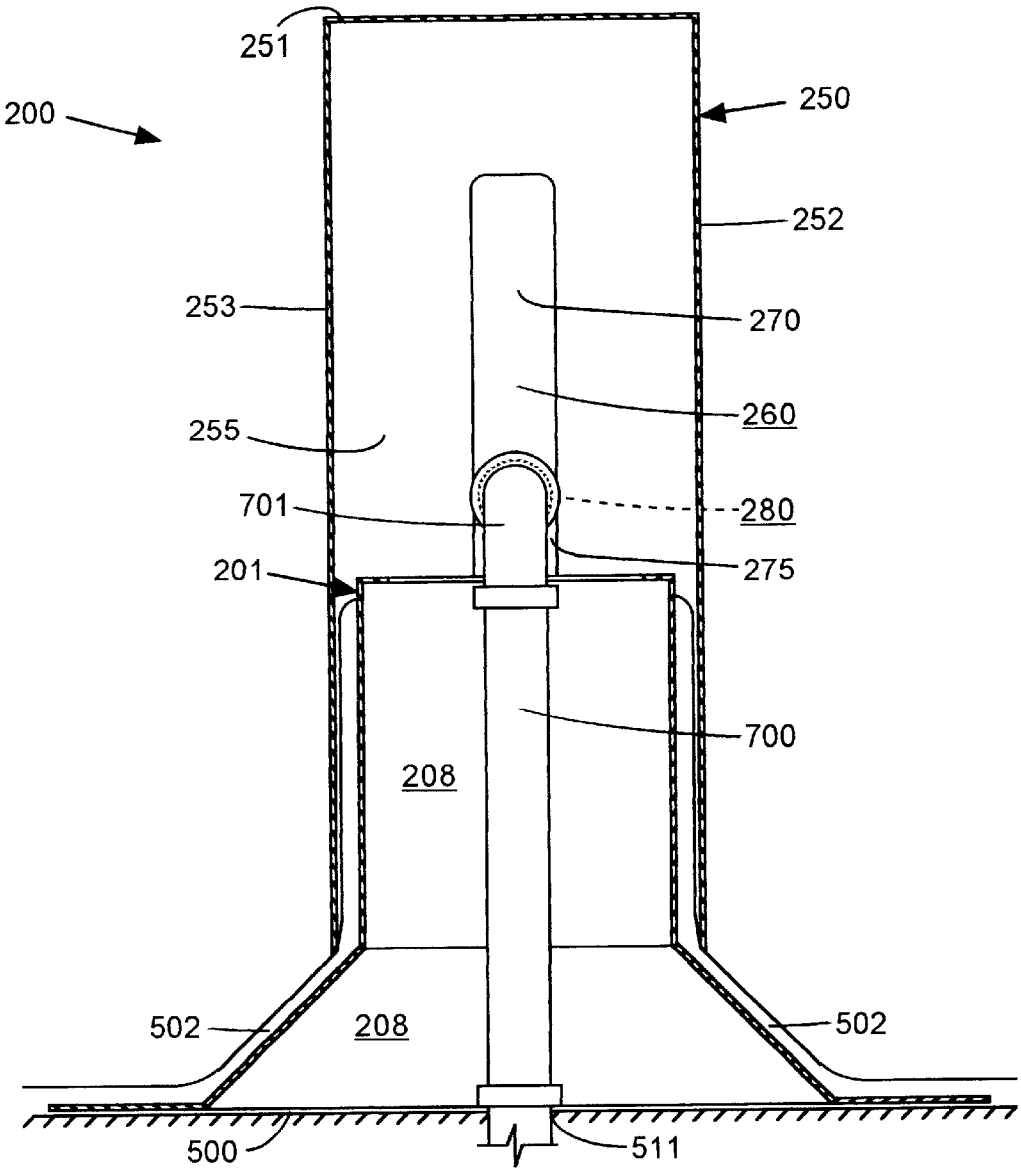
FIG. 12 is a section elevation view taken along section line 12—12 in FIG. 11.

Base assembly 201 extends peripherally around a defined interior region 208 (see FIGS. 11, 12). However, unlike interior region 108 of base assembly 101(which by definition is that portion of the interior below opening 166 (see FIG. 3)), interior region 208 of base assembly 201 is the entire interior region of the base assembly.

Since base assembly 201 is otherwise substantially the same as base assembly 101, including flanges and channels to facilitate sliding engagement of base sections 210, 270, the construction of base assembly 201 and its parts will not be discussed in further detail.

Hood 250 is engageable with base assembly 201 to cover the entire upper wall structure of base assembly 201 including the open top defined by perimeter 205. Hood 250 includes a top wall 251, parallel opposed side walls 252, 253, a rear side wall 254 extending transversely between side walls 252, 253, and a front side wall 255 also extending transversely between side walls 252, 253. All side walls extend downwardly from top wall 250 to an open bottom 256 (see FIG. 11).

Figure 15:
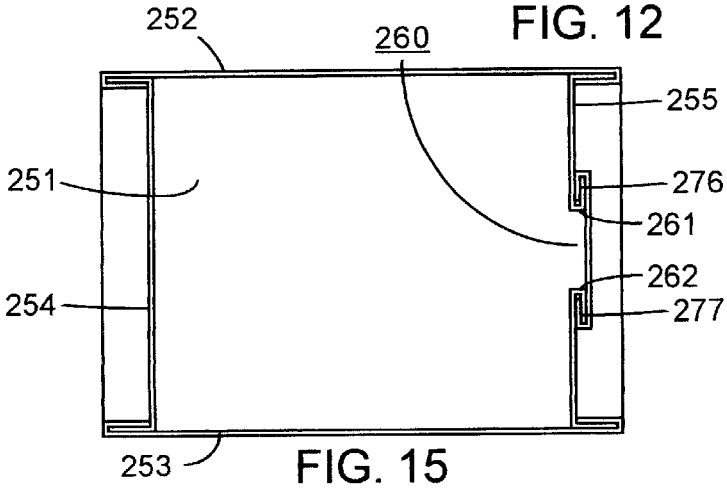
FIG. 15 is a bottom plan view of the hood shown in FIG. 14.
Figure 13:
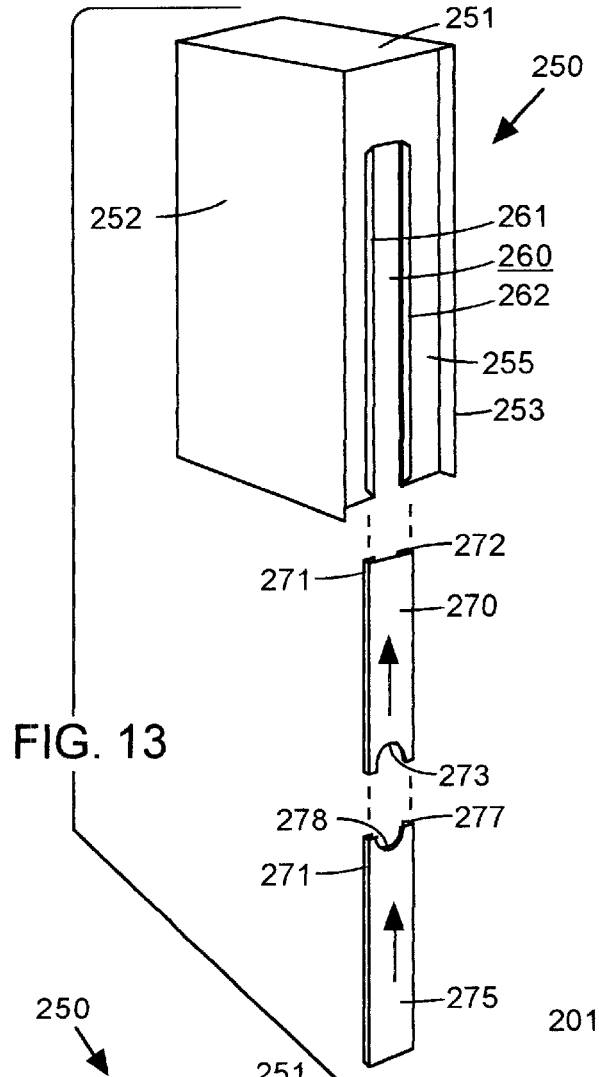
FIG. 13 is an exploded perspective view of the hood forming part of the housing shown in FIG. 8.

Front side wall 255 includes a centrally disposed elongated slot 260 extending upwardly from open bottom 260 for a substantial part of the wall height and, when assembled as shown in FIGS. 11–12, well above the top of base assembly 201. As best seen in FIGS. 13, 15, guide rails 261, 262 formed integrally with wall 255 extend lengthwise on opposed sides of slot 260.

Figure 8:
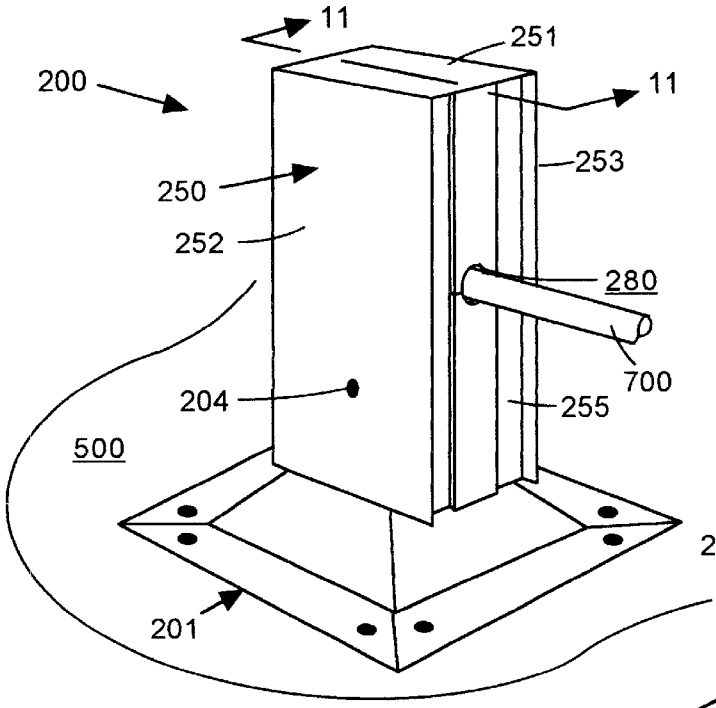
FIG. 8 is a perspective view of a housing in accordance with the present invention used to enclose the juncture between a roof and a pipe extending upwardly through the roof. For the purpose of illustration, integration of the housing with the roof is not shown.
Figure 9:
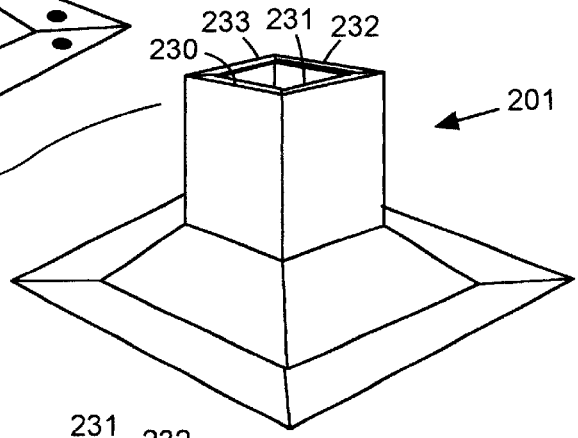
FIG. 9 is a perspective view of the base assembly forming part of the housing shown in FIG. 8.
Figure 16:
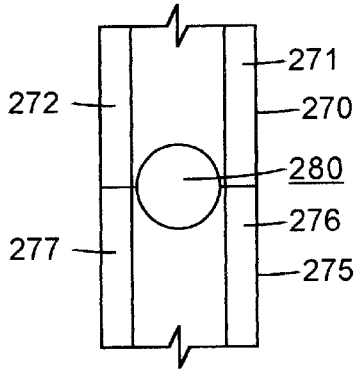
FIG. 16 is a rear elevation view of the slide panels forming part of the hood shown in FIG. 14.
Figure 14:
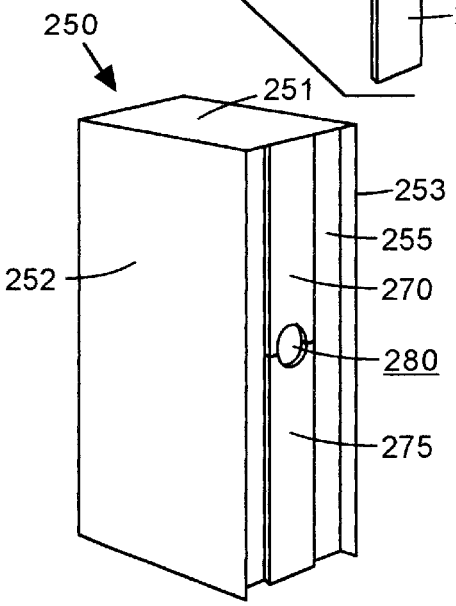
FIG. 14 is a perspective view of the hood shown in FIG. 13 when assembled.

Guide rails 261, 262 are sized and positioned to carry a pair of panels 270, 275 each of which extend across slot 260. Panels 270, 275 include opposed flanges 271, 272 and 276, 277, respectively, for slidingly engaging the rails and thus wall 255. As indicated in FIG. 13, the panels are received longitudinally by rails 261, 262. When fully received, and as best seen in FIGS. 8, 14 the two panels are in longitudinal abutment; the bottom of panel 270 abutting the top of panel 275. This position of abutment is also illustrated in FIG. 16.

The bottom of panel 270 includes a downwardly facing semicircular recess 273. The top of panel 275 includes an upwardly facing semicircular recess 278. Both recesses have the same radius and are positioned to form a circular conduit opening 280 when panels 270, 275 are brought into longitudinal abutment. As best indicated in FIGS. 8, 11 and 12, opening 280 is sized to provide a passage for pipe 700.

Installation and Use

Figure 10:
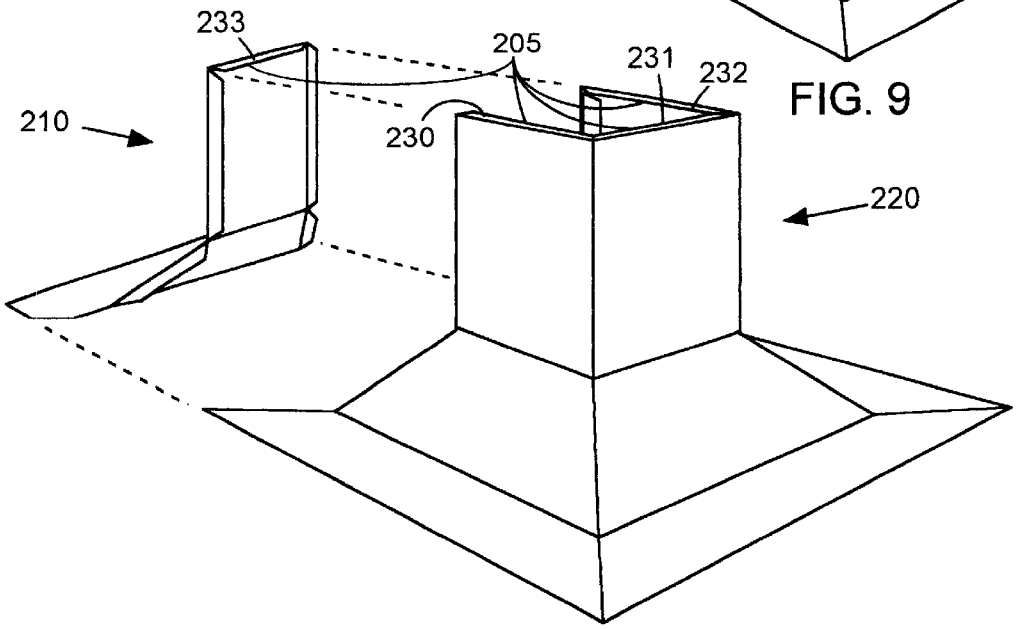
FIG. 10 is an exploded perspective view of the base assembly shown in FIG. 9

In use, the first step is to fabricate the discrete components of housing 200 as shown in FIGS. 10 and 15 (viz. base sections 210, 220 and hood 250 including panels 270, 275). As in the case of housing 100, this work is preferably done in a metal fabrication plant and not at the building site.

However, if the height of pipe 700 is not precisely known at the time of fabrication, then it may be considered desirable to initially fabricate the length of at least one of panels 270, 275 to a length approaching the length of slot 260. Then, at the building site, the height of pipe 700 can be measured, and the lengths of the panels can be easily trimmed on site to accommodate the circumstances. Such circumstances are highlighted by the example of FIG. 18 where pipe 800 extends horizontally at an elevation significantly higher than the elevation of pipe 700 in FIG. 8. The embodiment shown in FIG. 18, includes a base assembly 201 as in the case of FIG. 8, and a hood 250*a* having panels 270*a*, 275*a* slidingly engaged with front wall 255. The only difference between hood 250*a* and hood 250 is that the length of panel 270*a* is significantly shorter than the length of panel 270 and the length of panel 275*a* is significantly longer than the length of panel 275. Consequently, conduit opening 280*a* for pipe 800 is significantly higher than conduit opening 280 for pipe 700. Otherwise, housing 300 is substantially the same as housing 200.

Figure 17:
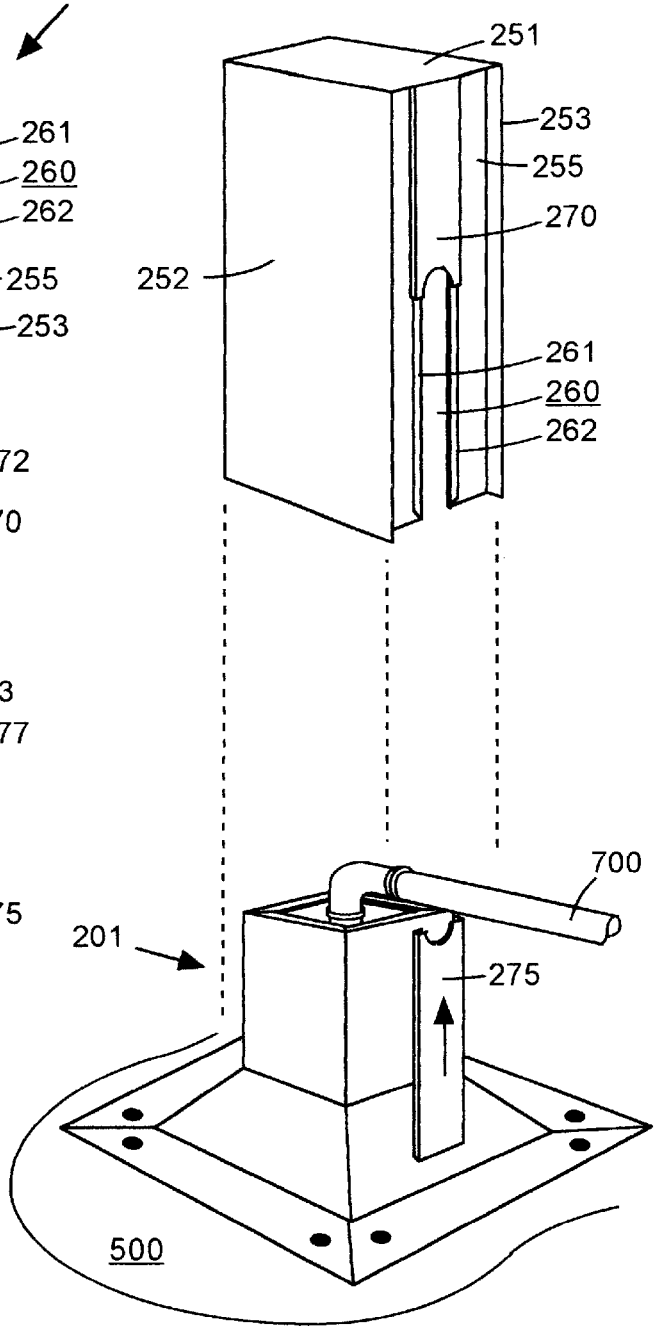
FIG. 17 is an exploded perspective view showing final steps in the assembly of the hood shown in FIG. 13 with the base assembly shown in FIG. 9 to provide the housing shown in FIG. 8.
Figure 18:
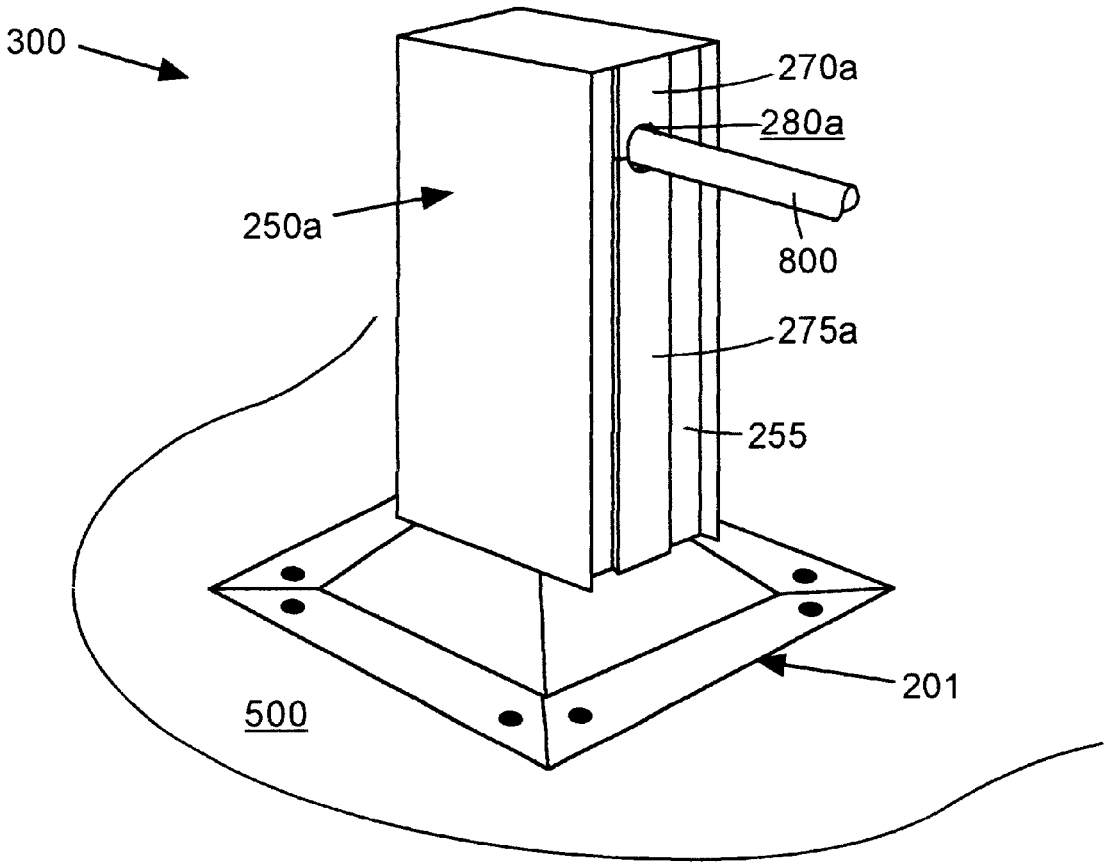
FIG. 18 is a perspective view of a housing substantially the same as the housing shown in FIG. 8, the one difference being that the lengths of the slide panels in the hood have been altered to accommodate a pipe which is higher than the pipe shown in FIG. 8.

Continuing with the description of the embodiment as shown in FIGS. 8–17, the first step at a building site is to assemble base sections 210, 220 as shown in FIG. 10 to form base assembly 201 around pipe 700 as shown in the lower part of FIG. 17. As shown in FIGS. 11–12 and 17, pipe 700 then extends upwardly from juncture 511 through interior region 208 of base assembly 201 to elbow 701 of the pipe. From elbow 701, pipe 700 extends horizontally above the top of base assembly 201 and above roof 500.

Next, the base flanges of base assembly 201 are secured to roof 500 by means of suitable fasteners. Then, before the addition of hood 250, base assembly 201 is integrated with roof 500 when the roof is completed with roofing surface 502. As indicated in FIGS. 11–12, roofing surface 502 extends across roof 500 and over the base flanges of base assembly 201, and is then formed upwardly and over the intermediate and upper side walls of base assembly 201.

Then, housing 200 is completed with the addition of hood 250. Assuming that panels 270, 275 have already been cut to length, the first completion step is to engage panel 270 with front wall 255 of the hood. Then, with panel 270 engaged and panel 275 manually held below pipe 700 as shown in FIG. 17, the next step is to lower the hood (except panel 275) down over base assembly 201 with pipe 700 extending through slot 260. Concurrently, panel 275 is maneuvered into sliding engagement with rails 261, 262 during the lowering process. The lowering continues until the bottoms of side walls 252, 253 come to rest on roofing surface 502 atop base assembly 201. If necessary, final adjustments are made to the positions of panels 270, 275 so that they are in longitudinal abutment. Note: If it is found that panel 270 was cut a bit too short, then it may be lowered on rails 261, 262 to a limited degree without undesirably exposing the top of slot 260.

From FIG. 12, it will be noted that the width of hood 250 between side walls 252, 253 is sufficient to accommodate not only the upper width of base assembly 201, but also the thickness of roofing surface 502 as it extends over the upper side walls of base assembly 201. To prevent excessive left to right movement of the hood relative to base assembly 201 as shown in FIG. 12, the combined horizontal distance between side walls 252, 253 and the vertically extending parts of roofing surface 502 preferably is small.

From FIG. 13, it will be noted that the width of hood 250 between rear side wall 254 and front side wall 255 is significantly greater than the upper width of base assembly 201. Relative to base assembly 101, hood 250 is positioned maximally to the right in FIG. 13. This is a preferred position because three of the four side walls of hood 250 (front side wall 255 being the exception) are then resting on roofing surface 502 atop base assembly 201. Further, front side wall 255 preferably is positioned a distance away from roofing surface 502 when hood 250 is positioned maximally to the right as in FIG. 13. This distance creates working room to adjust the position of panel 275. Further, if it is found that panel 275 was cut a bit too short, then the room will permit the panel to extend to a limited degree below the bottom of front side wall 255.

When hood 250 is finally positioned, it may be considered loosely engaged with the base assembly. The entire upper side wall structure of base assembly 201, including the open top defined by perimeter 205, is now covered. As well, juncture 511 between roof 500 and pipe 700 is now fully enclosed. The final position is preferably secured by fastening hood 250 to the base assembly. This may be done quickly and simply with a pair of screws, one through side wall 252 and into base assembly 201 (viz. screw 204 depicted in FIG. 8); the other (not shown) through opposed side wall 253 and into base assembly 201.

Finally, it normally will be considered desirable to seal opening 280 around pipe 700. Various commercially available sealants can serve this purpose, for example, silicone sealants. The use of such sealants also can compensate for situations where panels 270, 275 are not brought into longitudinal abutment to actually touch one another. If a small gap is present, then the sealant may be used to fill both opening 280 and the gap, thereby bringing the panels into abutment via the sealant.

Considering, for example, that pipe 700 may be a pipe connecting to an air conditioner or some other utility (not shown) in a region external to housing 200, it will be apparent that it may remain fully in situ during the installation of housing 200 and that there will be no need to disconnect the pipe from the utility. Further, it will be apparent that minimal work is required on site to assemble the housing and to integrate it with roof 500.

VARIATIONS

In principle, it will be evident that a housing having the same general construction as housing 100 could be used for a rigid pipe conduit rather than a flexible cable conduit such as cable 600, or that a housing having the same general construction as housing 200 could be used for a flexible cable conduit rather than rigid pipe conduit such as pipe 700.

Further, is to be understood that various modifications and changes can be made to the form, details, arrangement and proportion of the various parts described with reference to the embodiments described above without departing from the scope of the present invention. The invention is not to be construed as limited to the particular embodiments that have been described and should be understood as encompassing those embodiments which are within the spirit and scope of the claims that follow.

I claim:

1. A conduit housing for enclosing the juncture between a roof and an elongated conduit while said conduit is in situ, said conduit comprising a first portion extending upwardly through said roof and a second portion extending horizontally above said roof, said housing comprising:

(a) first and second base sections horizontally slidably engageable on said roof with each other around said conduit to form a base assembly comprising four sides adjoined to define an interior region containing at least a lower portion of said first portion of said conduit, said base assembly having an open top and extending peripherally around said interior region, each of said sides comprising (i) an outwardly extending base flange securable to said roof;

(ii) an intermediate side wall extending on a cant upwardly and inwardly from said base flange; and, (iii) an upper side wall extending substantially vertically from said intermediate side wall to said open top;

(b) a hood engageable with said base assembly to cover said open top;

(c) a conduit opening extending through and down from the top of one of said upper side walls, said opening being sized to provide a passage for said second portion of said conduit from within said interior region to an external region outside said housing; and, (d) a conduit channel extending outwardly from said conduit opening, said channel being sized to provide a passage for said conduit for a distance outwardly from said conduit opening; said hood being sized to cover both said open top and said channel.

2. A conduit housing for enclosing the juncture between a roof and an elongated conduit while said conduit is in situ, said conduit comprising a first portion extending upwardly through said roof and a second portion extending horizontally above said roof, said housing comprising:

(a) first and second base sections horizontally slidably engageable on said roof with each other around said conduit to form a base assembly comprising four sides adjoined to define an interior region containing at least a lower portion of said first portion of said conduit, said base assembly having an open top and extending peripherally around said interior region, each of said sides comprising (i) an outwardly extending base flange securable to said roof;

(ii) an intermediate side wall extending on a cant upwardly and inwardly from said base flange; and, (iii) an upper side wall extending substantially vertically from said intermediate side wall to said open top;

(b) a hood engageable with said base assembly to cover said open top, said hood comprising a top wall and side walls extending downwardly from said top wall to an open bottom; said upper side walls of said base assembly extending upwardly wholly within said side walls of said hood; and, (c) a conduit opening located in and extending through a front one of said sides walls of said hood, said opening being sized to provide a passage for said second portion of said conduit from within said interior region to an external region outside said housing, wherein said front one of said side walls includes an elongated slot extending upwardly from said open bottom, and wherein said conduit opening is an opening between a longitudinally abutting pair of panels extending across said slot while slidably engaged with said front one of said side walls.

3. A conduit housing as defined in claim 1, wherein said first base section is a unit comprising three of said four sides, namely, a pair of parallel extending opposed sides and a third side transversely interconnecting said opposed sides; and wherein said second base section is a unit comprising one of said four sides, said one of said four sides being slidably engageable with said opposed sides to form said base assembly.

4. A conduit housing as defined in claim 3, wherein said conduit opening extends through and down from the top of the upper side wall of said third side.

5. A conduit housing as defined in claim 2, wherein said first base section is a unit comprising three of said four sides, namely, a pair of parallel extending opposed sides and a third side transversely interconnecting said opposed sides; and wherein said second base section is a unit comprising one of said four sides, said one of said four sides being slidably engageable with said opposed sides to form said base assembly.

6. A conduit housing as defined in claim 5, wherein said front one of said side walls includes an elongated slot extending upwardly from said open bottom, and wherein said conduit opening is an opening between a longitudinally abutting pair of panels extending across said slot while slidably engaged with said front one of said side walls.

* * * * *